US008391739B2

(12) United States Patent
Kobayashi

(10) Patent No.: US 8,391,739 B2
(45) Date of Patent: Mar. 5, 2013

(54) IMAGE FORMING APPARATUS

(75) Inventor: Kiyotaka Kobayashi, Osaka (JP)

(73) Assignee: Kyocera Mita Corporation (JP)

( * ) Notice: Subject to any disclaimer, the term of this patent is extended or adjusted under 35 U.S.C. 154(b) by 239 days.

(21) Appl. No.: 12/822,273

(22) Filed: Jun. 24, 2010

(65) Prior Publication Data

US 2010/0329721 A1 Dec. 30, 2010

(30) Foreign Application Priority Data

Jun. 30, 2009 (JP) ..... 2009-155843

(51) Int. Cl.
*G03G 15/00* (2006.01)
*G03G 21/00* (2006.01)

(52) U.S. Cl. ..... 399/71; 399/167; 399/357

(58) Field of Classification Search ..... 399/71, 399/167, 357
See application file for complete search history.

(56) References Cited

U.S. PATENT DOCUMENTS 5,175,584 A * 12/1992 Usui ..... 399/44
5,657,114 A * 8/1997 Kitajima et al. ..... 399/71
6,775,511 B2 * 8/2004 Kosuge ..... 399/346
7,274,884 B2 * 9/2007 Yamauchi ..... 399/25
7,286,785 B2 * 10/2007 Hashimoto et al. ..... 399/101
2008/0056786 A1 * 3/2008 Ishino et al. ..... 399/357
2008/0304884 A1 * 12/2008 Nishida ..... 399/349
2009/0041510 A1 * 2/2009 Imahashi et al. ..... 399/277
2009/0110416 A1 * 4/2009 Thayer et al. ..... 399/34
2009/0169236 A1 * 7/2009 Fukao et al. ..... 399/99
2009/0279914 A1 * 11/2009 Iwasaki ..... 399/71
2009/0311007 A1 * 12/2009 Mochizuki et al. ..... 399/167
2010/0215388 A1 * 8/2010 Saitoh ..... 399/50

FOREIGN PATENT DOCUMENTS

JP 10-133510 5/1998
JP 2006-126753 5/2006
JP 2010060679 A * 3/2010

* cited by examiner

*Primary Examiner* — David Gray
*Assistant Examiner* — Tyler Hardman
(74) *Attorney, Agent, or Firm* — Gerald E. Hespos; Michael J. Porco; Matthew T. Hespos

(57) ABSTRACT

An image forming apparatus has an image carrier for carrying toner. A charger charges the surface of the image carrier and an exposure part then forms an electrostatic latent image thereon. A developer uses toner to develop the electrostatic latent image and a transfer part transfers a toner image from the image carrier to a recording medium. A cleaning roller has a circumferential surface that contacts with the surface of the image carrier and removes deposits therefrom by using toner that the circumferential surface carries. A carrier driver drives the image carrier and a power detector detects power consumption of the carrier driver. A roller controller determines, based on the detected power consumption whether a removal capacity of the cleaning roller to remove the deposits needs to be increased, and then controls rotation of the cleaning roller in response to a result of the determination.

4 Claims, 10 Drawing Sheets

FIG.8

| DRIVING TIME T | $T_1$ | $T_2$ | ····· | $T_{n-1}$ | $T_n$ |
|---|---|---|---|---|---|
| INCREASED AMOUNT OF RIVING CURRENT $\Delta I$ | $\Delta I_1$ | $\Delta I_2$ | ····· | $\Delta I_{n-1}$ | $\Delta I_n$ |

IMAGE FORMING APPARATUS

BACKGROUND OF THE INVENTION

1. Field of the Invention

The present invention belongs to a technical field of a printer, a copy machine, a multi-function machine or other image forming apparatuses, and particularly relates to a cleaning technology for removing toner or other deposits remaining on an image carrier.

2. Description of the Related Art

As an image carrier, a photosensitive drum has been widely used in an electrophotographic image forming apparatus such as a copy machine and a printer. In the image forming apparatus that uses the photosensitive drum, a charging device uniformly charges the circumferential surface of the photosensitive drum to a predetermined potential, and then, based on image data, part of the potential is optically attenuated by irradiating the circumferential surface of the photosensitive drum with an LED of an exposure device to form an electrostatic latent image corresponding to an image on an original document. Then, a toner image is formed on the circumferential surface of the photosensitive drum by developing this electrostatic latent image using a developing device. The toner image is transferred to a paper sheet when the paper sheet passes through a transfer region that is configured by bringing the photosensitive drum into contact with, or close to, a transfer member.

In this type of image forming apparatus, after transferring the toner image to the paper sheet some toner often remains deposited on the circumferential surface of the photosensitive drum without being transferred to the paper sheet. The photosensitive drum needs to be cleaned because the residual toner on the circumferential surface of the photosensitive drum stands in the way of subsequent new image formation. A variety of cleaning methods are widely known. Examples of the cleaning methods used here include a method of pressing a cleaning roller, rotating brush, or other rotary member to the circumferential surface of the photosensitive drum to move and collect the residual toner to the rotary member, a method of bringing a cleaning blade into contact with the circumferential surface of the photosensitive drum to scrape the residual toner off the circumferential surface of the photosensitive drum, and a method that combines these cleaning methods.

On the other hand, when an amorphous silicon photoreceptor is used as a photoreceptor, discharge products produced by the discharge of the charging device are easily deposited onto the circumferential surface of the amorphous silicon photoreceptor. The electric resistance of the circumferential surface of the photoreceptor decreases as the discharge products absorb the moisture, causing image deletion that disturbs the electrostatic latent image. There is thus known a method of adding a small amount of abrasive to a toner, carrying the toner on the circumferential surface of a cleaning roller, and causing this toner to grind the discharge products deposited on the circumferential surface of the photoreceptor.

A first known technology has a magnetic brush for grinding the surface of a photosensitive drum and a light quantity sensor for detecting the quantity of surface-reflected light of the photosensitive drum, wherein the magnetic brush is operated according to the value of the quantity of surface-reflected light of the photosensitive drum other than when forming an image.

A second known technology aims to effectively remove foreign matters deposited on the circumferential surface of a photosensitive drum, even when the image area ratio varies with each part of the circumferential surface of the photosensitive drum. In this technology the photosensitive drum is divided into six blocks in a main scanning direction, and the number of dots being written is counted for each of the six blocks until the rotating time of the photosensitive drum reaches a predetermined time. Then, the image area ratio of each block is obtained. Regarding the blocks with the image area ratios that are equal to or lower than a reference value, an electrostatic latent image with a predetermined toner consumption pattern is formed on the photoreceptor, toner is then deposited by developing means, and the toner is forcibly cleaned using cleaning means.

In the image forming apparatus using the first technology, the quantity of surface-reflected light of the photosensitive drum is measured, and then the magnetic brush is operated based on the measured value. Consequently, scraping the film of the photosensitive drum causes fluctuations in the quantity of surface-reflected light, and the light quantity sensor becomes dirty as the toner scatters, reducing the detection accuracy of the light quantity sensor. Furthermore, when the quantity of surface-reflected light cannot be detected in the entire axial direction of the photosensitive drum, the operation for grinding the surface of the photosensitive drum by using the magnetic brush might not be able to be carried out when necessary, or the operation for grinding the surface of the photosensitive drum by using the magnetic brush might be performed even when unnecessary.

In the image forming apparatus using the second technology, the toner is supplied to a section that is not printed, as a countermeasure to poor grinding, as well as for the purpose of preventing bending of the cleaning brush due to the reverse rotation thereof or preventing clogging. The problem, therefore, is the increase in toner consumption. There is also known a technology for reversely rotating the cleaning roller to increase its grinding force, wherein when the cleaning roller is reversely rotated without supplying the toner in order to suppress toner consumption, polishing is not performed sufficiently, causing an image defect.

SUMMARY OF THE INVENTION

An object of the present invention is to provide an image forming apparatus that is capable of carrying out a cleaning operation while reducing the risk of a cost increase resulted from mounting a new sensor, such as a light quantity sensor for measuring the quantity of surface-reflected light of a photosensitive drum, as well as the risk of an increase in toner consumption.

An image forming apparatus according to an aspect of the present invention has: an image carrier for carrying toner on a surface thereof; a charging part for uniformly charging the surface of the image carrier; an exposure part for forming an electrostatic latent image by performing an exposure operation, based on image data, on the surface of the image carrier after the image carrier is subjected to a charging operation by the charging part; a developing part for developing the electrostatic latent image formed on the surface of the image carrier by using the toner; a transfer part for transferring a toner image formed on the surface of the image carrier, to a predetermined recording medium; a cleaning roller that has a circumferential surface coming into sliding contact with the surface of the image carrier and carrying the toner, and that removes deposits that are deposited on the surface of the image carrier by using the toner that the circumferential surface carries; a carrier driving part for driving the image carrier; a power detector for detecting power consumption of the carrier driving part during an image formation period in which an image forming operation for forming an image onto the image carrier based on the image data is performed; and a roller controller for determining, based on the power consumption detected by the power detector, whether a removal capacity of the cleaning roller to remove the deposits needs to be increased or not, and then controlling a rotation operation of the cleaning roller in response to a result of the determination.

Moreover, an image forming apparatus according to an aspect of the present invention has: an image carrier for carrying toner on a surface thereof; a charging part for uniformly charging the surface of the image carrier; an exposure part for forming an electrostatic latent image by performing an exposure operation, based on image data, on the surface of the image carrier after the image carrier is subjected to a charging operation by the charging part; a developing part for developing the electrostatic latent image formed on the surface of the image carrier by using the toner; a transfer part for transferring a toner image formed on the surface of the image carrier, to a predetermined recording medium; a cleaning roller that has a circumferential surface coming into sliding contact with the surface of the image carrier and carrying the toner, and that removes deposits that are deposited on the surface of the image carrier by using the toner that the circumferential surface carries; a print ratio detector for detecting a print ratio of an image formed during an image formation period in which an image forming operation for forming an image onto the image carrier based on the image data is performed; and a roller controller for determining, based on the print ratio detected by the print ratio detector, whether a removal capacity of the cleaning roller to remove the deposits needs to be increased or not, and then controlling a rotation operation of the cleaning roller in response to a result of the determination, wherein the print ratio indicates a ratio of an area in which the toner is deposited to an area of the image formed on the recording medium.

BRIEF DESCRIPTION OF THE DRAWINGS

FIG. 8 is a table showing the relationship between driving time and driving current.

DETAILED DESCRIPTION OF THE PREFERRED EMBODIMENTS

Figure 1:
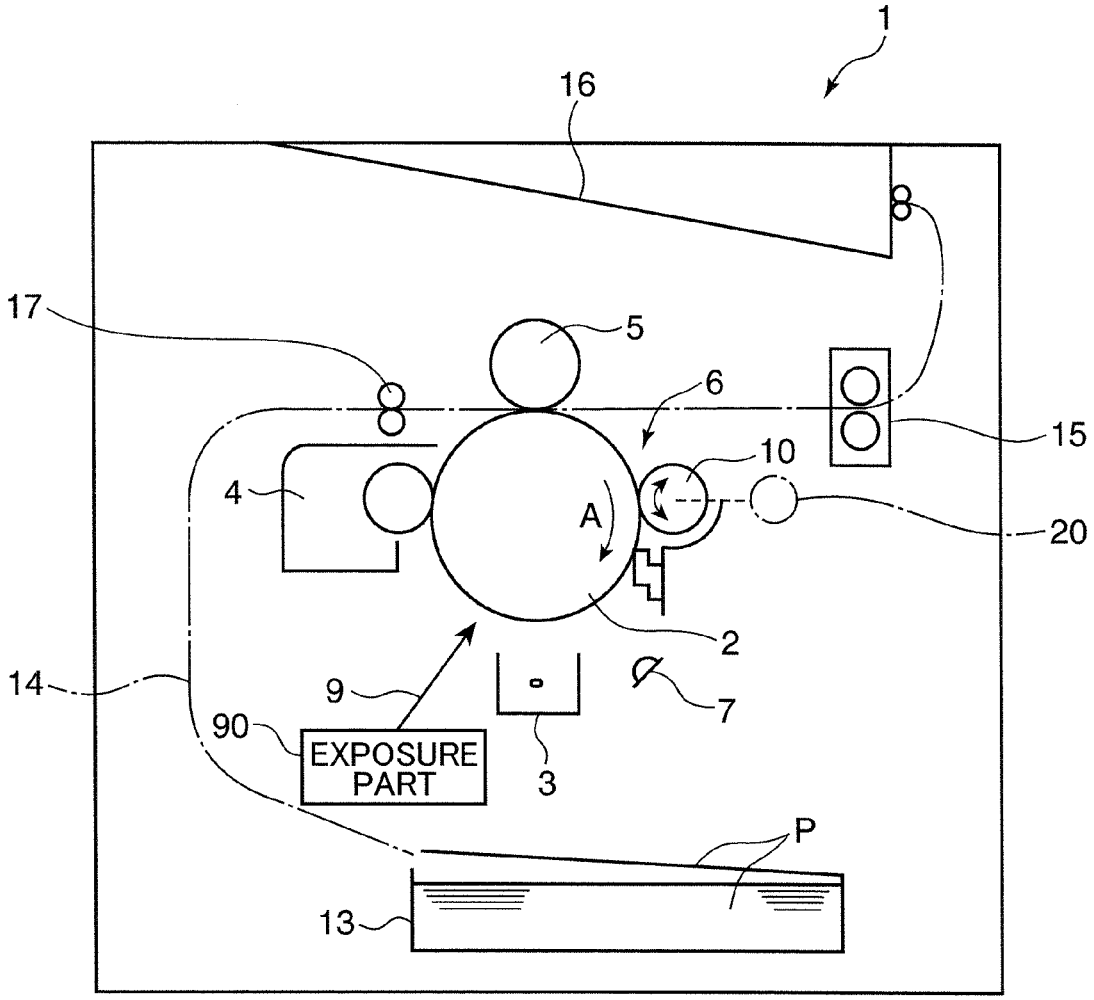
FIG. 1 is a diagram schematically showing an internal configuration of one embodiment of an image forming apparatus according to the present invention.

Embodiments of the image forming apparatus according to the present invention are now described hereinafter with reference to the drawings. FIG. 1 is a front view showing an example of the image forming apparatus.

As shown in FIG. 1, an image forming apparatus 1 has a cylindrical photosensitive drum 2 as an image carrier, the circumferential surface (surface) of which is made from amorphous silicon. Around the photosensitive drum 2 are arranged a charger (same as the charging part) 3, a developing device (same as the developing part) 4, a transfer roller (same as the transfer part) 5 as an example of a transfer body, a cleaning unit 6, and a static eliminator 7, in a rotation direction of the photosensitive drum 2. Toner is held in the developing device 4. The toner is configured such that an abrasive such as silica, alumina, zirconia, or titania is deposited to a circumferential surface of a binder resin, which is a base particle of the toner. In addition to the binder resin, the toner contains pigment, wax, or charge control agent at a rate of, for example, approximately 30%.

Note that the image carrier may not necessarily be in the shape of a drum, but may be a belt-like photoreceptor.

An image forming operation is performed by the image forming apparatus 1 as follows. After the charger 3 uniformly charges the surface of the photosensitive drum 2 to a predetermined potential, the surface of the photosensitive drum 2 is exposed to light by irradiating the surface of the photosensitive drum 2 with a laser beam 9 using an exposure part 90, in accordance with image data. As a result, an electrostatic latent image is formed on the photosensitive drum 2. Thereafter the electrostatic latent image on the photosensitive drum 2 is developed to a toner image by the developing device 4, and then the toner image on the photosensitive drum 2 is transferred to a transfer material, such as a sheet P (recording paper), by the transfer roller 5. At the time of this transfer, a transfer bias electric field is applied between the photosensitive drum 2 and the transfer roller 5, and the charged toner is moved smoothly to the sheet P serving as a recording medium. Note that the recording medium includes an intermediate transfer body and other member that temporarily carries the toner image.

Toner remaining on the photosensitive drum 2 after the transfer is removed by the cleaning unit 6. Thereafter residual potential on the photosensitive drum 2 is eliminated by the static eliminator 7. Then, the photosensitive drum 2 is charged again by the charger 3, and the image forming process described above is repeated.

The sheet P, on the other hand, is reeled out from a paper cassette 13, conveyed along a conveyance line 14, and then sent to between the photosensitive drum 2 and the transfer roller 5. The toner image on the photosensitive drum 2 is then transferred to the sheet P by the transfer roller 5. Thereafter the sheet P having the toner image transferred thereto is discharged to a catch tray 16 through a fixing unit 15. Note that a pair of resist rollers 17 is provided upstream from the transfer roller 5 on the conveyance line 14, and the sheet P abuts on and stops at this resist roller pair 17. The resist roller pair 17 is driven in synchronized timing with image formation on the photosensitive drum 2, and the sheet P is sent toward a transfer nip between the photosensitive drum 2 and the transfer roller 5.

In the image forming apparatus 1 with such a configuration, the transfer roller 5 is disposed above the photosensitive drum 2, and the conveyance line 14 is so provided as to pass through between the photosensitive drum 2 and the transfer roller 5. The cleaning unit 6 is provided downstream of the conveyance line 14 and downstream of the rotation direction of the photosensitive drum 2 from the transfer roller 5.

Figure 2:
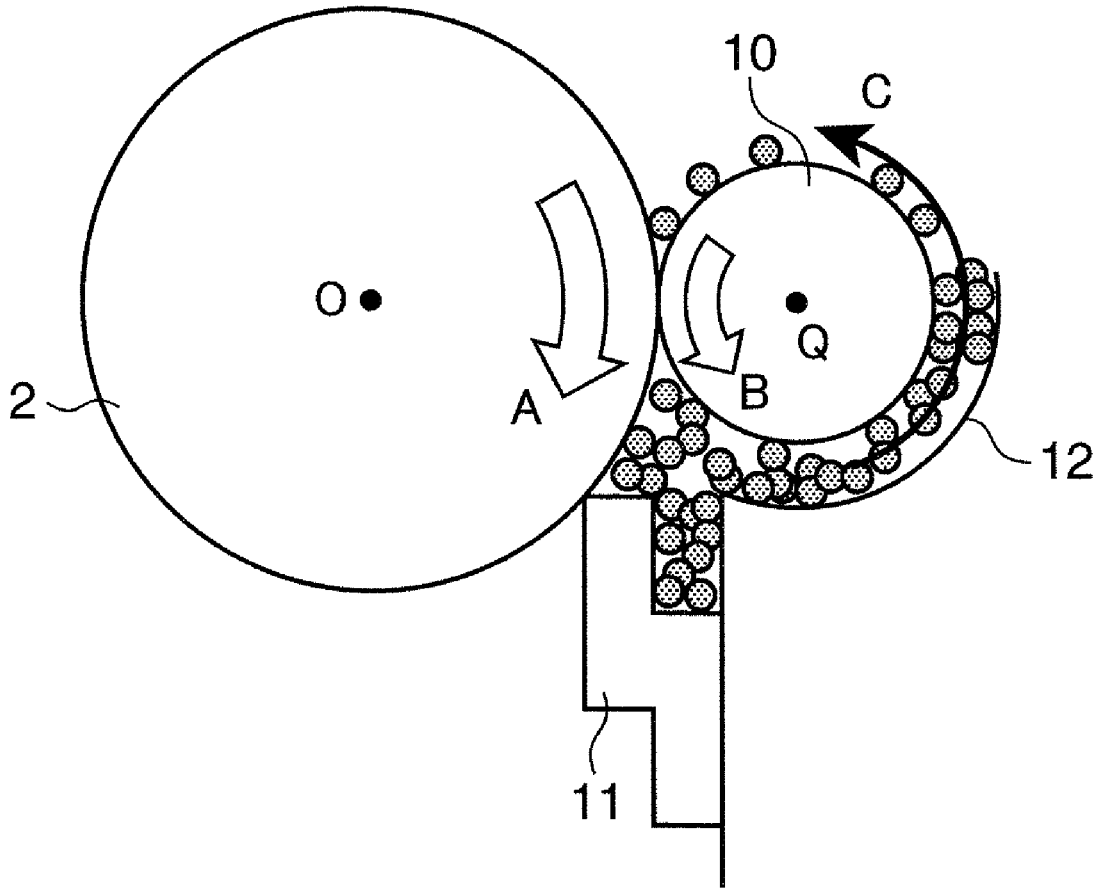
FIG. 2 is a diagram showing a configuration of a cleaning unit.

FIG. 2 is an enlarged view showing a configuration of the cleaning unit 6.

The cleaning unit 6 has a cleaning roller 10, a cleaning blade 11 installed on the underside of the cleaning roller 10, i.e., downstream of the photosensitive drum 2 in the rotation direction as viewed from the cleaning roller 10, and a plate roll (same as a toner receiving member) 12 installed in the vicinity of the cleaning roller 10.

The cleaning roller 10 in the shape of a cylinder rotates around a rotation axis Q that is in parallel with a rotation axis O of the photosensitive drum 2 while having a circumferential surface of the cleaning roller 10 in sliding contact (contact) with the circumferential surface of the photosensitive drum 2. The photosensitive drum 2 and the cleaning roller 10 are arranged adjacent to each other in substantially a horizontal direction such that the circumferential surfaces thereof come into contact with each other. The cleaning roller 10 is driven by a drive motor 20 (see FIG. 1). The drive motor 20 is configured so as to be able to rotate in both normal and reverse directions, and the cleaning roller 10 rotates in a direction corresponding to the rotation direction of the drive motor 20. The rotation directions of the drive motor 20 are switched by a roller controller 24 (see FIG. 3) (described later) for switching between, for example, voltage application directions.

The cleaning roller 10 is configured using, for example, foamed rubber and has fine concavity and convexity on its circumferential surface. These concavity and convexity allow the toner to be deposited on the circumferential surface of the cleaning roller 10.

The cleaning blade 11 comes into contact with the circumferential surface of the photosensitive drum 2 at a predetermined position below the cleaning roller 10 (a position downstream of the rotation direction of the photosensitive drum 2), to scrape the toner off the photosensitive drum 2.

The plate roll 12 is a member for forming a retaining space for the toner scraped by the cleaning blade 11. In other words, the plate roll 12 has a curved surface that curves along the circumferential surface of the cleaning roller 10, with a predetermined gap therefrom, on the outside of a radial direction on the cross section of the cleaning roller 10, i.e., across the cleaning roller 10 from the photosensitive drum 2. The space surrounded by the curved surface of the plate roll 12, the circumferential surfaces of the cleaning roller 10 and the photosensitive drum 2, and the cleaning blade 11 is formed as the retaining space.

When the radius of the photosensitive drum 2 is set in the range of, for example, 20 mm to 50 mm, and the radius of the cleaning roller 10 is set in the range of, for example, 10 mm to 30 mm, the distance (space) between the plate roll 12 and the cleaning roller 10 is set in the range of, for example, 1 mm to 5 mm.

It is preferred that the plate roll 12 extend to a position as high as, or higher than, the contact area between the cleaning roller 10 and the photosensitive drum 2 (the contact area referred to as "nip part" hereinafter) along the circumferential surface of the cleaning roller 10 that is on the other side of the photosensitive drum 2, so that the toner retained in the retaining space is deposited easily on the circumferential surface of the cleaning roller 10. Note that the height of the position here indicates the vertical height from the ground.

After the electrostatic latent image formed on the circumferential surface of the photosensitive drum 2 is developed into a toner image by the toner supplied from the developing device 4, the toner that remains on the circumferential surface of the photosensitive drum 2 without being transferred to the sheet P when the toner image is transferred to the sheet P is scraped off the cleaning blade 11 by the cleaning unit 6. The scraped toner is retained in the retaining space. When the toner retained in the retaining space reaches the position on the circumferential surface of the cleaning roller 10, the cleaning roller 10 carries the toner on the circumferential surface thereof and scoops the toner retained in the retaining space, as shown by the arrow C in FIG. 2.

Figure 3:
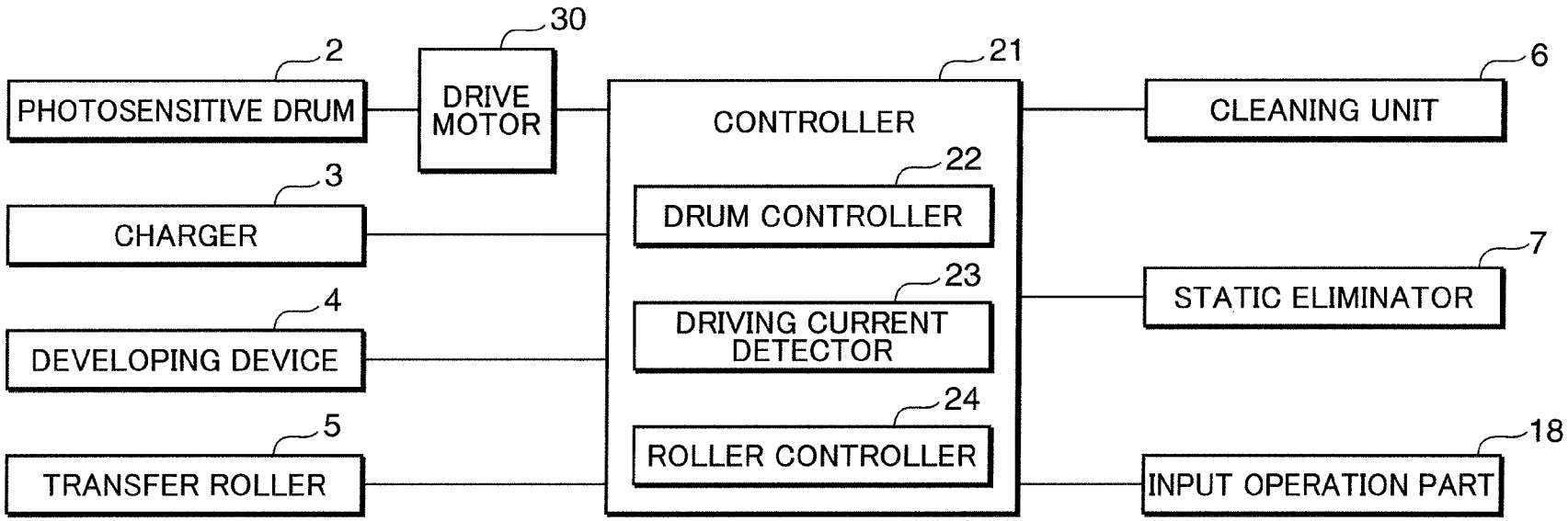
FIG. 3 is a block diagram showing an electrical configuration of an image forming apparatus according to a first embodiment.

FIG. 3 is a block diagram showing an example of an electrical configuration of the image forming apparatus 1 shown in FIG. 1. As shown in FIG. 3, the image forming apparatus 1 has an input operation part 18 and a controller 21, in addition to the photosensitive drum 2, charger 3, developing device 4, transfer roller 5, cleaning unit 6, and static eliminator 7 that are mentioned above.

Although not described in detail, the input operation part 18 includes a numeric key for inputting the number of prints and the like, a start button for starting a printing operation and the like, a stop/clear button for stopping the printing operation or canceling the input operation, and a reset button for bringing various settings to an initial state or standard operating state.

The controller 21 is configured by, for example, a CPU (Central Processing Unit) for executing an arithmetic processing, a ROM (Read Only Memory) in which a predetermined control program is stored, and a RAM (Random Access Memory) for temporarily storing data. The photosensitive drum 2, charger 3, developing device 4, transfer roller 5, cleaning unit 6, and static eliminator 7 that are mentioned above are connected to the controller 21.

The controller 21 of the present embodiment functions as a drum controller 22 (an example of a carrier controller), a driving current detector (an example of the power detector) 23, and a roller controller 24. One example of a cleaning device is configured by the cleaning unit 6, the driving current detector 23, and the roller controller 24.

The drum controller 22 controls the rotation operation (drive operation) of the photosensitive drum 2. In the present embodiment, when the image forming apparatus 1 executes the image forming operation, the drum controller 22 rotates the photosensitive drum 2 in a predetermined rotation direction (the direction shown by the arrow A in FIG. 1). During a period in which the image forming apparatus 1 does not execute the image forming operation, when increasing the rotation speed of the cleaning roller 10 as will be described hereinafter, the drum controller 22 continuously rotates the photosensitive drum 2 at the same speed, otherwise stops the rotation operation of the photosensitive drum 2. The speed of movement of the circumferential surface of the photosensitive drum 2 or cleaning roller 10 is called "circumferential speed." The circumferential speed of the photosensitive drum 2 during the image formation is set in the range of, for example, 75 mm/sec to 500 mm/sec.

Even when the rotation speed (driving speed) of the photosensitive drum 2 changes, the drum controller 22 controls the rotation speed of a drive motor 30 so as to immediately return the rotation speed of the photosensitive drum 2 to the speed before the change. The drive motor 30 is an example of the carrier driving part. As an example of a configuration of detecting the rotation speed of the photosensitive drum 2, the drum controller 22 can adopt a configuration of installing an encoder in the photosensitive drum 2 and detecting the speed of the photosensitive drum 2 based on an output signal of the encoder.

In other words, the encoder is configured by an encode plate with a plurality of encode patterns, and an encoder brush. One of the encode plate or the encoder brush is installed in a section where the photosensitive drum 2 rotates and the other one is installed on the rotation axis, so that the encoder patterns coming into contact with the encoder brush are switched as the photosensitive drum 2 rotates. The encoder brush outputs a signal corresponding to the type of the encode pattern that comes into contact. The drum controller 22 detects the rotation speed of the photosensitive drum 2 based on the speed at which the type of the output signal of the encoder brush changes.

The drum controller 22 calculates the difference between the detected rotation speed of the photosensitive drum 2 and a reference value that is stored in the image forming apparatus 1 beforehand, and controls the operation of the drive motor 30 so that this difference becomes zero. Consequently, the drum controller 22 rotates the photosensitive drum 2 at preset reference speed. Note in the present embodiment that, because the drive motor 30 driving the photosensitive drum 2 is driven at constant voltage, the driving current supplied to the drive motor 30 is increased to raise the power supplied, when increasing the rotation speed of the photosensitive drum 2. On the other hand, the driving current supplied to the drive motor 30 is reduced to lower the power supplied, when reducing the rotation speed of the photosensitive drum 2.

In addition, when adjusting the driving current, the drum controller 22 sets the driving current by, for example, referring to a driving current value of the drive motor 30 that is detected by the driving current detector 23, so that the driving current value becomes an appropriate value.

Note that the voltage at which the drive motor 30 is driven is not limited to the constant voltage. For example, the drum controller 22 may increase both the driving voltage and driving current supplied to the drive motor 30, to raise the power supplied, when increasing the rotation speed of the photosensitive drum 2. On the other hand, when reducing the rotation speed of the photosensitive drum 2, the drum controller 22 may reduce both the driving voltage and the driving current supplied to the drive motor 30, to lower the power supplied.

The driving current detector 23 detects the driving current of the drive motor 30 driving the photosensitive drum 2. The driving current of the drive motor 30 is the same as consumption current of the drive motor 30. As the driving current detector 23, various current detection circuits that are configured using, for example, a shunt resistance, hall element, or analog/digital convertor can be used.

Here, when the driving voltage of the drive motor 30 is set at constant voltage, the driving current of the drive motor 30 that is detected by the driving current detector 23 can be used as information indicating the power consumption of the drive motor 30 because the power consumption of the drive motor 30 is proportional to the driving current.

When the driving voltage of the drive motor 30 is not constant, the consumption current of the drive motor 30 may be detected by, for example, further providing a voltage detector for detecting the driving voltage of the drive motor 30, and multiplying the driving voltage detected by the voltage detector by the driving current detected by the driving current detector 23. In this case, the voltage detector and the driving current detector 23 are examples of the power detector.

Moreover, even when the driving voltage of the drive motor 30 is not constant, when the drum controller 22 controls the driving voltage and the driving current of the drive motor 30 by creating a correlation between the driving voltage and the driving current where one of them increases as the other increases, either one of the voltage detector and the driving current detector 23 can be used as the power detector, and either one of the detected driving voltage and driving current can be used as the information indicating the power consumption of the drive motor 30.

The roller controller 24 controls the rotation operation of the cleaning roller 10 and rotates the cleaning roller 10 in a direction opposite to the rotation direction of the photosensitive drum 2, as shown by the arrow B in FIG. 2. In other words, the cleaning roller 10 is rotated in the same direction in which the circumferential surface of the photosensitive drum 2 moves in the contact area between the circumferential surface of the cleaning roller 10 and the circumferential surface of the photosensitive drum 2.

Here, in the present embodiment, the roller controller 24 controls the rotation operation of the cleaning roller 10 according to the driving current of the drive motor 30 that is detected by the driving current detector 23.

In other words, discharge products or other deposits that are produced by the discharge of the charging device are often deposited onto the circumferential surface of the photosensitive drum 2. When such deposits are deposited onto the circumferential surface of the photosensitive drum 2, kinetic frictional between the photosensitive drum 2 and the cleaning roller 10 increases, and the rotation speed of the photosensitive drum 2 changes (decreases) in a condition where a constant drive torque is applied to the cleaning roller 10.

Therefore, in the present embodiment as mentioned above, even when the rotation speed of the photosensitive drum 2 changes, the rotation speed of the drive motor 30 is controlled so that the rotation speed of the photosensitive drum 2 immediately returns to the rotation speed before the change. Thus, even when the kinetic frictional force between the photosensitive drum 2 and the cleaning roller 10 increases and the rotation speed of the photosensitive drum 2 drops due to the deposits that are deposited onto the circumferential surface of the photosensitive drum 2, the drum controller 22 performs the control so as to raise the rotation speed of the drive motor 30 so that the rotation speed of the photosensitive drum 2 immediately returns to the rotation speed before the change. At this moment, the drive motor 30 consumes much more electric power. Specifically, the changes in the driving current of the drive motor 30 are the parameter (barometer) that shows whether the deposits are present on the circumferential surface of the photosensitive drum 2 or not.

Figure 10:
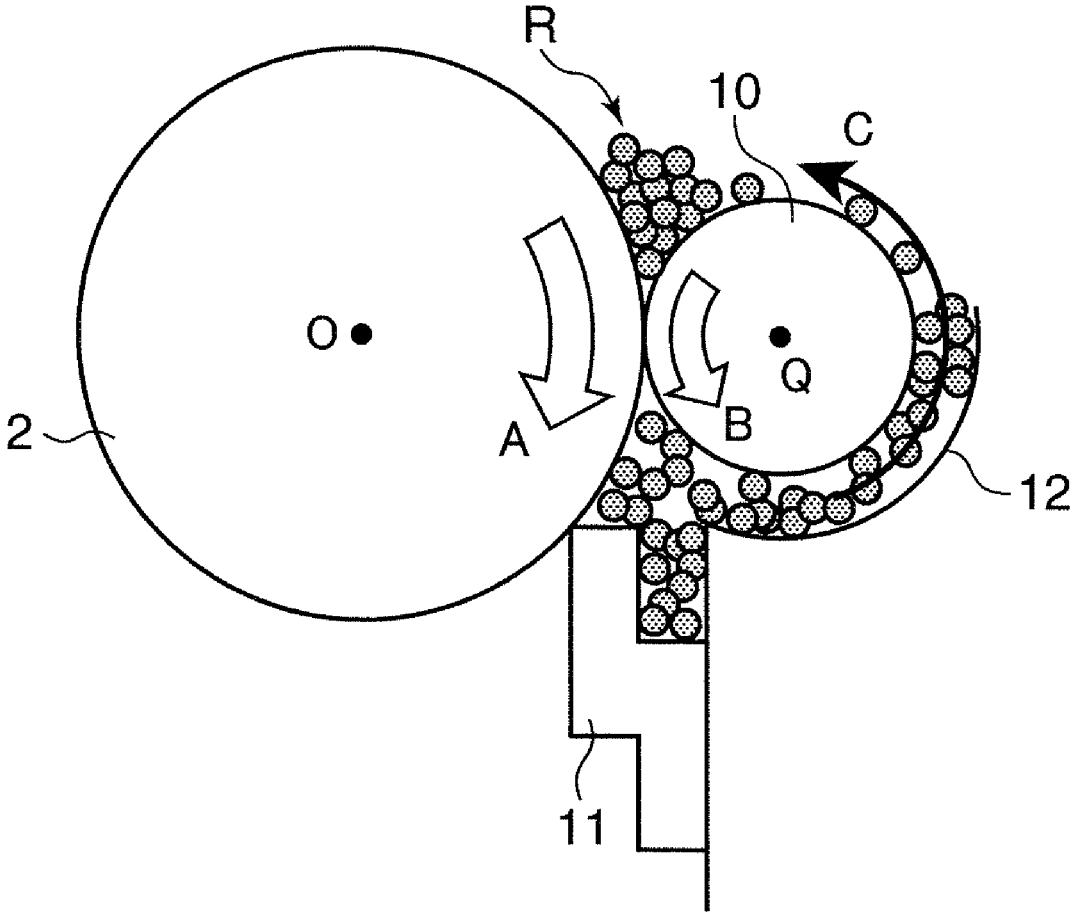
FIG. 10 is a diagram showing a state in which a toner pool is generated in an upper part of a contact area between a cleaning roller and a photosensitive drum by increasing the rotation speed of the cleaning roller.

Focusing on this factor, in the present embodiment, when the driving current of the drive motor 30 becomes greater than a predetermined threshold value during the image formation period, the roller controller 24 increases the rotation speed of the cleaning roller 10 to a predetermined speed that is higher than the rotation speed obtained during the image formation period, during a non-image formation period after the end of the image formation period. By increasing the rotation speed of the cleaning roller 10 in this manner, the amount of toner that is supplied per unit time to the nip part between the photosensitive drum 2 and the cleaning roller 10 increases, forming a toner pool R above the nip part, as shown in FIG. 10. As a result, compared to the case with the image formation period, the operation for removing the deposits can be performed on the photosensitive drum 2 by using a sufficient amount of toner, and the scraping capacity of the cleaning roller 10 to scrape the deposits off the circumferential surface of the photosensitive drum 2 can be improved.

Figure 4:
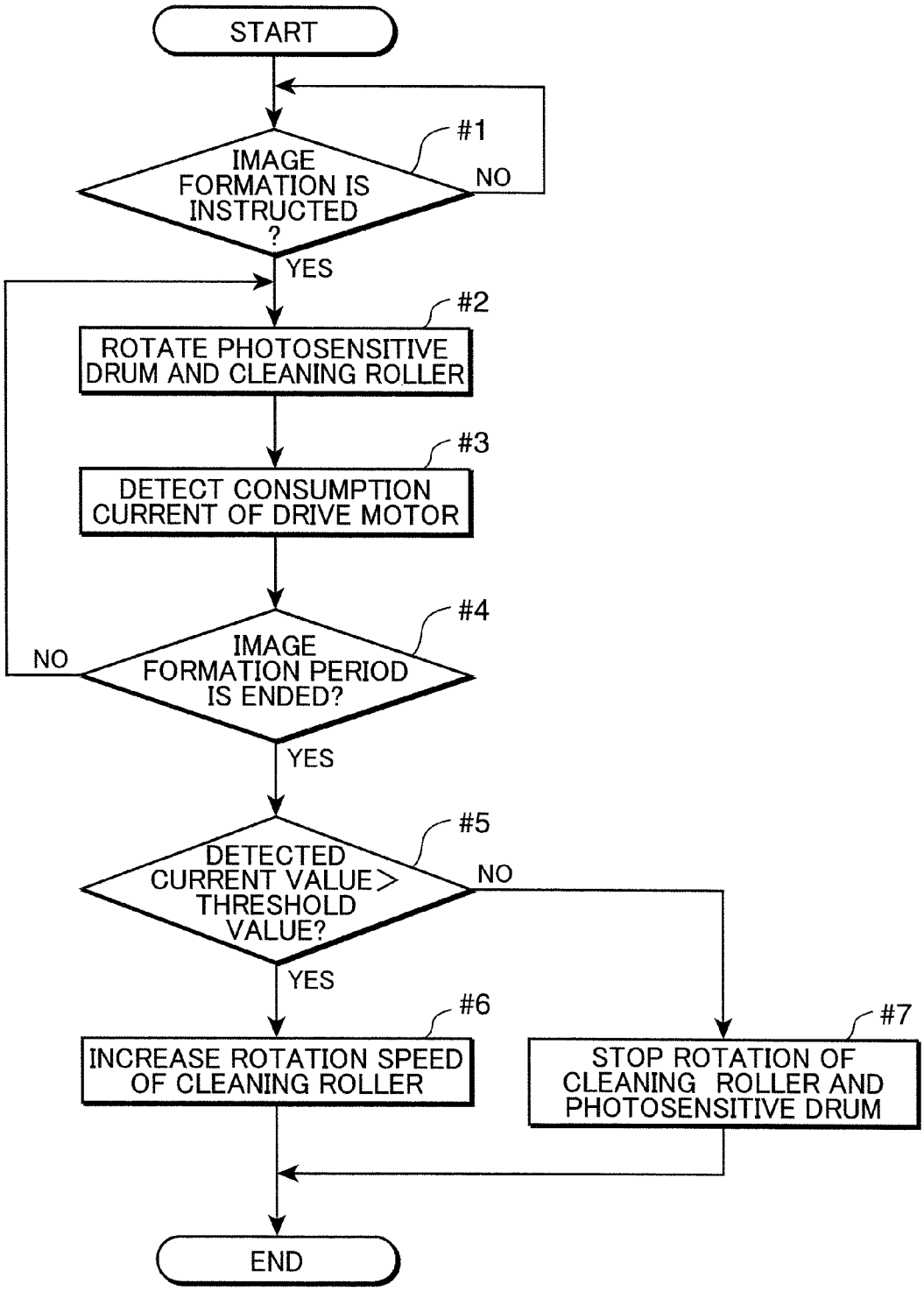
FIG. 4 is a flowchart showing a process performed by a controller according to the first embodiment.

FIG. 4 is a flowchart showing a process performed by the controller 21.

As shown in FIG. 4, when the input operation part 18 inputs an instruction on the image forming operation (YES in step #1), the drum controller 22 rotates the photosensitive drum 2 in a predetermined direction (the direction shown by the arrow A in FIG. 2), while the roller controller 24 rotates the cleaning roller 10 in the normal direction (step #2). The rotation of the cleaning roller 10 in the normal direction means the rotation in a direction opposite to the rotation direction of the photosensitive drum 2, which is the direction shown by the arrow B in FIG. 2. Consequently, the toner retained by the plate roll 12 is supplied to the circumferential surface of the photosensitive drum 2 by the cleaning roller 10. As a result, the deposits that are deposited on the circumferential surface of the photosensitive drum 2 in the image forming operation is removed from the circumferential surface of the photosensitive drum 2 by the abrasive contained in the toner.

Moreover, the driving current detector 23 detects the driving current of the drive motor 30 driving the photosensitive drum 2. The driving current of the drive motor 30 is the same as the consumption current of the drive motor 30 (step #3). The drum controller 22 constantly controls the driving current of the drive motor 30 to rotate the photosensitive drum 2 at the preset reference speed after starting the rotation of the photosensitive drum 2.

The roller controller 24 executes the processes of steps #2 and #3 (NO in step #4) until the image forming operation completes (the image formation period ends). Once the image forming operation completes (YES in step #3), the roller controller 24 determines whether the detected current value obtained by the driving current detector 23 exceeds a predetermined threshold value or not (step #5). In step #5, because the photosensitive drum 2 and the cleaning roller 10 are driven in a similar way during the image formation period, the consumption current of the drive motor 30 in step #5 is same during the image formation period. Therefore, in step #5 the detected current value detected by the driving current detector 23 becomes the information indicating the power consumption of the drive motor 30.

Note that the detected current value detected by the driving current detector 23 during the image formation period may be stored, and the detected current value stored in step #5 may be used. The detected current value and the threshold value may be compared, and the result of the comparison may be stored. The conditions may be branched in step #5 based on the comparison result.

When the roller controller 24 determines that the detected current value obtained by the driving current detector 23 exceeds the threshold value (YES in step #5), the roller controller part 24 increases the rotation speed of the cleaning roller 10 to a predetermined rotation speed (step #6). As a result, the amount of toner supplied to the photosensitive drum 2 by the cleaning roller 10 increases, and the removal capacity to remove the deposits improves. The deposits on the circumferential surface of the photosensitive drum 2 are then removed by the abrasive contained in the toner.

When, on the other hand, the roller controller 24 determines that the detected current value obtained by the driving current detector 23 is equal to or lower than the threshold value (NO in step #5), the roller controller 24 stops the rotation of the cleaning roller 10, and the drum controller 22 stops the rotation of the photosensitive drum 2 (step #7). The cleaning roller 10 is rotated for a predetermined time period required for removing the deposits after the rotation speed is increased in step #6, and thereafter the rotation of the cleaning roller 10 and the photosensitive drum 2 is stopped. In step #7, the drumcontroller 22 and the roller controller 24 may stop rotation of the photosensitive drum 2 and the cleaning roller 10 after controlling the photosensitive drum 2 and the cleaning roller 10 to rotate for a predetermined time period at the same speed as the speed during the image formation period.

In the image forming operation, the rotation speed of the cleaning roller 10 is lower than the rotation speed of the photosensitive drum 2 by a predetermined value and is set at, for example, 95% of the rotation speed of the photosensitive drum 2. When increasing the rotation speed of the cleaning roller 10, the predetermined rotation speed is set at, for example, 110% of the rotation speed of the rotation speed of the photosensitive drum 2.

In this case, when the rotation speed of the cleaning roller 10 is increased in step #6, the absolute value of the difference between the rotation speed of the cleaning roller 10 and the rotation speed of the photosensitive drum 2 becomes greater than the absolute value of the difference between the rotation speed of the cleaning roller 10 and the rotation speed of the photosensitive drum 2 during the image formation period. Consequently, the friction between the cleaning roller 10 and the photosensitive drum 2 grows, increasing the removal capacity of the cleaning roller 10 to remove the deposits on the circumferential surface of the photosensitive drum 2.

The removal capacity to remove the deposits may be increased only by making the absolute value of the difference between the rotation speed of the cleaning roller 10 and the rotation speed of the photosensitive drum 2 greater than the absolute value of the difference between the rotation speed of the cleaning roller 10 and the rotation speed of the photosensitive drum 2 during the image formation period, without increasing the amount of toner supplied.

Note that the difference between the rotation speed of the cleaning roller 10 and the rotation speed of the photosensitive drum 2 is substantially equal to the difference between the speed of movement of the circumferential surface of the cleaning roller 10 and the speed of movement of the circumferential surface of the photosensitive drum 2. Therefore, when the image carrier is not in the drum shape, the difference in rotation speed may be replaced with the difference between the speed of movement of the circumferential surface of the cleaning roller 10 and the speed of movement of the surface of the image carrier.

As described above, in the present embodiment, whether the deposits are deposited on the circumferential surface of the photosensitive drum 2 or not is detected based on the driving current that is supplied to the drive motor 30 to rotary drive the photosensitive drum 2 (the consumption current of the drive motor 30), and when the deposits are deposited on the circumferential surface of the photosensitive drum 2 the rotation speed of the cleaning roller 10 is increased to the predetermined rotation speed. Here, the driving current detector 23 has been conventionally mounted in the image forming apparatus 1 in order to refer to the driving current value when, for example, the drum controller 22 adjusts the driving current.

Thus, the circumferential surface of the photosensitive drum 2 can be cleaned in response to the surface condition of the circumferential surface of the photosensitive drum 2 by using the structure that has been conventionally installed in image forming apparatus 1 (the driving current detector 23), without raising a concern about reduction of the detection accuracy of the sensor for detecting the surface condition of the circumferential surface of the photosensitive drum 2 by means of light, while such a concern is raised in the conventional technology in which the sensor is mounted independently in the image forming apparatus 1.

In addition, the toner that is scraped off the circumferential surface of the photosensitive drum 2 by the cleaning blade 11 is accumulated on the plate roll 12 and the accumulated toner is supplied to the nip part between the cleaning roller 10 and the photosensitive drum 2. Therefore, even when executing the image forming process with a low print ratio (for example, 2% or lower) at which the amount of residual toner supplied to the cleaning unit 6 decreases, the toner can be supplied reliably to the contact area between the cleaning roller 10 and the photosensitive drum 2 without needing to supply cleaning toner from the developing device 4 to the photosensitive drum 2 separately from the toner used for image formation. Consequently, the occurrence of poor grinding caused by insufficiency in toner can be prevented or inhibited.

Note that the print ratio is the ratio of the area to be printed (the area deposited with the toner) in relation to the area in which an image can be formed (the area of the sheet P, the area of the image).

The present invention the following modification can be adopted in place of or in addition to the embodiment described above.

(1) In the first embodiment, whether to increase the rotation speed of the cleaning roller 10 is determined based on the driving current (consumption current) of the drive motor 30 rotary driving the photosensitive drum 2, but not only the driving current of the drive motor 30 but also, for example, the print ratio of an image can be adopted as the parameter (barometer) for determining whether to increase the rotation speed of the cleaning roller 10.

The developing device 4 has a developing roller and a toner container, which are not shown. When executing the image forming operation, the toner in the toner container is supplied to a circumferential surface of the developing roller. Here, part of the toner supplied to the circumferential surface of the developing roller is supplied from the developing roller to the photosensitive drum 2 and used. The rest of the toner remains deposited on the developing roller of the developing device 4 without being used for image formation (without being supplied from the developing roller to the photosensitive drum 2). For example, when the image forming operation is performed at low print ratio, the amount of toner remaining on the developing roller is particularly large. Such toner remaining on the developing roller cannot have a necessary charge amount when left as is, and the amount of toner moving from the developing roller to the photosensitive drum 2 becomes smaller than a set value when the next and subsequent image forming operations are performed. As a result, the image density can be negatively impacted.

For this reason, when the input operation part (start button) inputs an image forming instruction, the toner deposited on the circumferential surface of the developing roller is discharged from the developing device 4 to the photosensitive drum 2 as unwanted toner at predetermined timing during the image formation period, such as prior to the formation of a first image, or between the completion of the image forming operation on the sheet P and the start of the image forming operation on the next sheet P when forming an image on a plurality of recording papers. The discharged unwanted toner is then collected to the pool space using the cleaning blade 11, in order to use the unwanted toner as the cleaning toner. Thus, mixture toner of the unwanted toner discharged from the developing device 4 to the photosensitive drum 2 and the toner (residual toner) that remains without being transferred from the photosensitive drum 2 to the sheet P is retained.

Incidentally, when the unwanted toner is compared with the residual toner, the residual toner has a higher content percentage of abrasive than the unwanted toner. This is because the abrasive that is externally added to the toner remains at the photosensitive drum 2 without moving from the photosensitive drum 2 to the sheet P when the toner is transferred from the photosensitive drum 2 to the sheet P.

The greater the print ratio of the image is, the higher the percentage of the abrasive that remains at the photosensitive drum 2. As a result, when the image forming operation is continued at a high print ratio, the content percentage of the abrasive in the toner that is collected from the photosensitive drum 2 and retained in the retaining space becomes high. At this moment, a sufficient cleaning operation can be conducted.

On the other hand, the lower the print ratio of the image is, the lower the percentage of the abrasive that remains at the photosensitive drum 2. As a result, when the image forming operation is continued at a low print ratio, the content percentage of the abrasive in the toner that is collected from the photosensitive drum 2 and retained in the retaining space becomes low. At this moment, it is going to be more likely that the sufficient cleaning operation is not performed.

Figure 5:
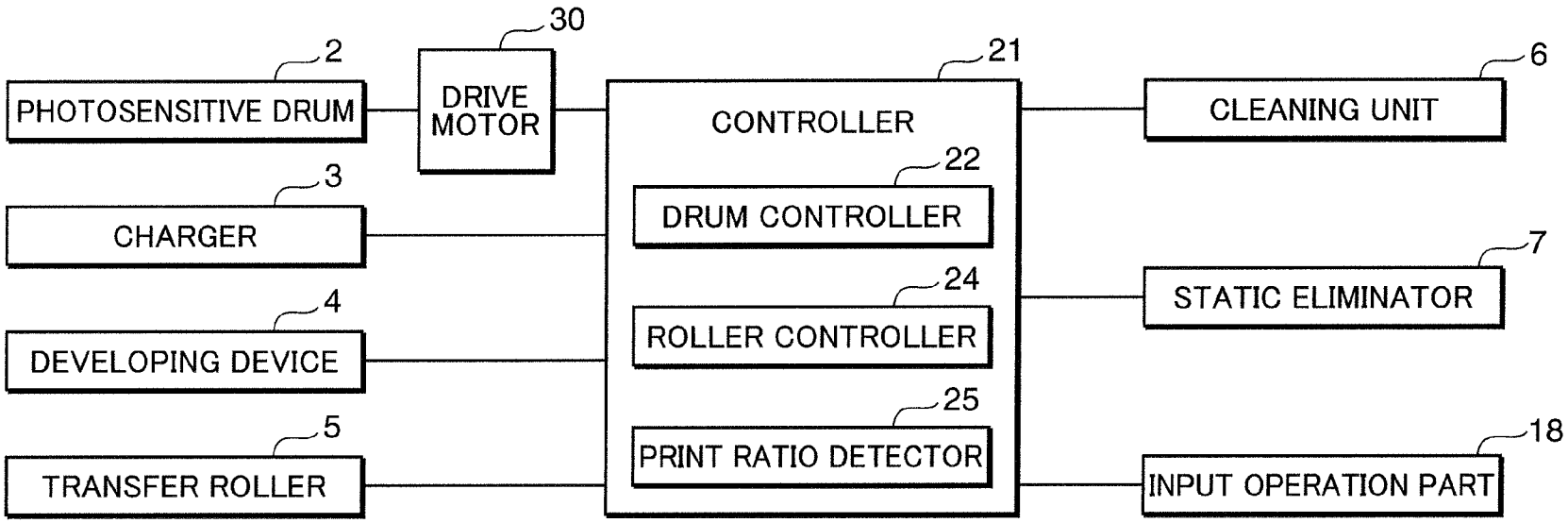
FIG. 5 is a block diagram showing an electrical configuration of an image forming apparatus according to a modification.

Therefore, when the print ratio is low in the image forming operation that is executed based on the instruction input from the input operation part 18, the amount of cleaning toner supplied from the retaining space to the nip part is increased by raising the rotation speed of the cleaning roller 10 during the non-image formation period after the image forming operation, so that sufficient cleaning can be performed. FIG. 5 shows an electrical configuration of the image forming apparatus 1 according to this embodiment. The same numbers are applied to the members or structures that are same as those of the first embodiment, and the explanations thereof are omitted.

As shown in FIG. 5, an image forming apparatus according to the present embodiment has a print ratio detector 25 in place of the driving current detector 23 of the image forming apparatus of the first embodiment. This print ratio detector 25 detects the print ratios of the sheets P used in the image forming operation that is executed based on the instruction input by the input operation part 18, and calculates the average value of the detected print ratios.

The print ratio detector 25 for example counts the number of print dots of image data, based on which an image is formed, and converts the number of print dots into a print ratio. For example, the print ratio detector 25 can calculate the print ratio by dividing the counted number of print dots by the total number of dots configuring image for one sheet P.

For example, the print ratio detector 25 additionally stores the control program in the ROM of the controller 21 and realizes this control program by causing the CPU to execute it. Therefore, because of this print ratio detector 25, no new hardware is required.

Figure 6:
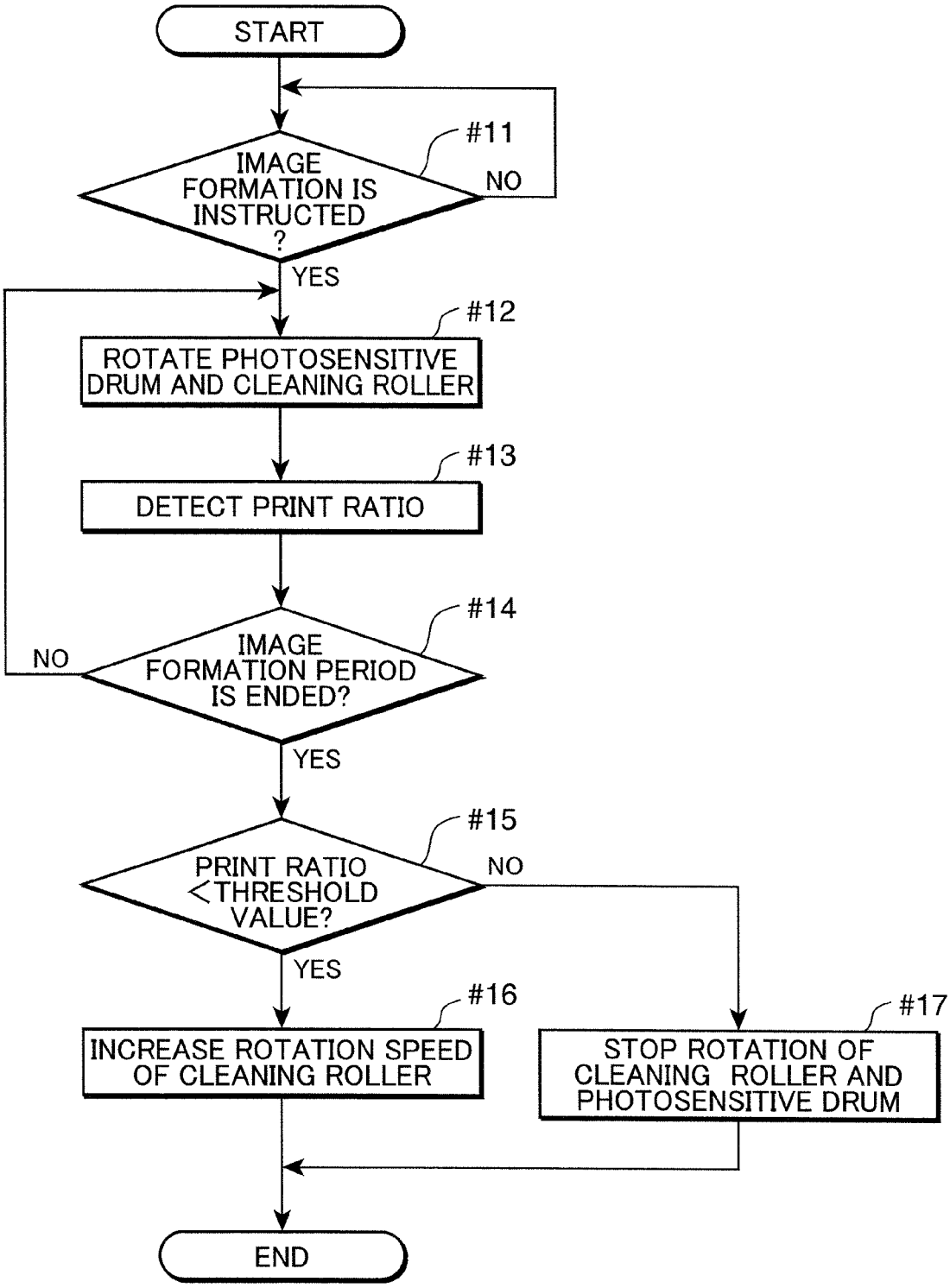
FIG. 6 is a flowchart showing a process performed by the controller according to the modification shown in FIG. 5.

FIG. 6 is a flowchart showing a process performed by the controller 21 according to the present embodiment.

As shown in FIG. 6, when the input operation part 18 inputs an instruction on the image forming operation (YES in step #11), the drum controller 22 rotates the photosensitive drum 2 in the predetermined direction (the direction shown by the arrow A in FIG. 2), while the roller controller 24 rotates the cleaning roller 10 in the normal direction (the rotation in a direction opposite to the rotation direction of the photosensitive drum 2) (step #12). The print ratio detector 25 detects the print ratio of each sheet P until the image forming operation based on the instruction input by the input operation part 18 (image formation period) ends (NO in steps #13 and #14).

Upon completion of the image forming operation (when the image formation period ends) (YES in step #14), the print ratio detector 25 calculates the average value of the print ratios of the images formed in this image forming operation, and the roller controller 24 determines whether the average value is smaller than a predetermined threshold value (step #15).

When the roller controller 24 determines that the average value is smaller than the threshold value (YES in step #15), the roller controller 24 raises the rotation speed of the cleaning roller 10 to a predetermined rotation speed (step #16).

The roller controller 24 rotates the cleaning roller 10 for a predetermined time period after the rotation speed is increased in step #16, and thereafter the rotation of the cleaning roller 10 and the photosensitive drum 2 is stopped.

In step #17, the drumcontroller 22 and the roller controller 24 may stop rotation of the photosensitive drum 2 and the cleaning roller 10 after controlling the photosensitive drum 2 and the cleaning roller 10 to rotate for a predetermined time period at the same speed as the speed during the image formation period.

When the roller controller 24 determines that the average value is greater than or equal to the threshold value (NO in step #15), the roller controller 24 stops the rotation of the cleaning roller 10 (step #17).

In the present embodiment as well, the circumferential surface of the photosensitive drum 2 can be cleaned only when necessary, by using the print ratio detector 25 that is realized using the hardware of the controller 21 that has conventionally been mounted in the image forming apparatus 1, without raising a concern about the changes in the detection accuracy of a sensor for detecting the surface condition of the circumferential surface of the photosensitive drum 2 by means of light, while such a concern is raised in the conventional technology in which the sensor is mounted independently in the image forming apparatus 1.

Here, although only the print ratio is assumed as another determination parameter for determining whether the rotation speed of the cleaning roller 10 needs to be increased or not, the discharge amount of unwanted toner to be discharged from the developing device 4 to the photosensitive drum 2 may be taken into consideration.

Specifically, because the residual toner and the unwanted toner that have different content percentages of abrasive are supplied to the retaining space, not only the print ratio associated with the residual toner, but also the amount of unwanted toner to be discharged from the developing roller to the retaining space via the photosensitive drum 2 can be taken into consideration, so that the removal capacity to remove the toner supplied from the retaining space to the nip part can be understood accurately, and whether the rotation speed of the cleaning roller 10 needs to be increased or not can be determined precisely.

(2) In the embodiment described above, the means of increasing the rotation speed of the cleaning roller 10 is adopted as the means of increasing the capacity of the cleaning roller 10 to remove the deposits deposited on the circumferential surface of the photosensitive drum 2. However, it is possible to adopt means for increasing the absolute value of the difference between the rotation speed of the cleaning roller 10 and the rotation speed of the photosensitive drum 2 by changing the rotation direction of the cleaning roller 10 to the direction opposite to the direction of the cleaning roller 10 rotating at the time of image formation. With this means as well, the circumferential speed difference (speed difference) between the circumferential speed (rotation speed) of the cleaning roller 10 and the circumferential speed (rotational speed) of the photosensitive drum 2 increases. Consequently, the friction between the cleaning roller 10 and the photosensitive drum 2 grows, increasing the removal capacity of the cleaning roller 10 to remove the deposits.

(3) As in the first embodiment described above, when adopting a cylindrical photosensitive drum made from amorphous silicon as the photosensitive drum 2, the condition of the circumferential surface of the photosensitive drum 2 changes (deteriorates) in accordance with the use thereof, and the sliding contact state between the photosensitive drum 2 and the cleaning roller 10 changes. As a result, the torque required for rotary driving the photosensitive drum 2 at constant speed, and eventually the driving current of the drive motor 30 for driving the photosensitive drum 2, might increase. Furthermore, the time degradation of the drive motor 30 and the entry of dusts and the like between the rotation axis of the photosensitive drum 2 and a bearing of the rotation axis can increase the kinetic friction resistance therebetween. Similarly, the entry of dusts and the like between a gear of the photosensitive drum 2 that is coupled to the drive motor 30 and a gear shaft also can increase the kinetic friction resistance therebetween. These factors might increase the driving current of the drive motor 30.

Given that whether to increase the rotation speed of the cleaning roller 10 or not should be determined based on the driving current of the drive motor 30 that changes as the torque fluctuates due to the deposits deposited on the circumferential surface of the photosensitive drum 2, the increased amount of the driving current that is generated by the deterioration due to the use of the drive motor 30 is preferably not included in the driving current that is used for determining whether to increase the rotation speed of the cleaning roller 10.

Figure 7:
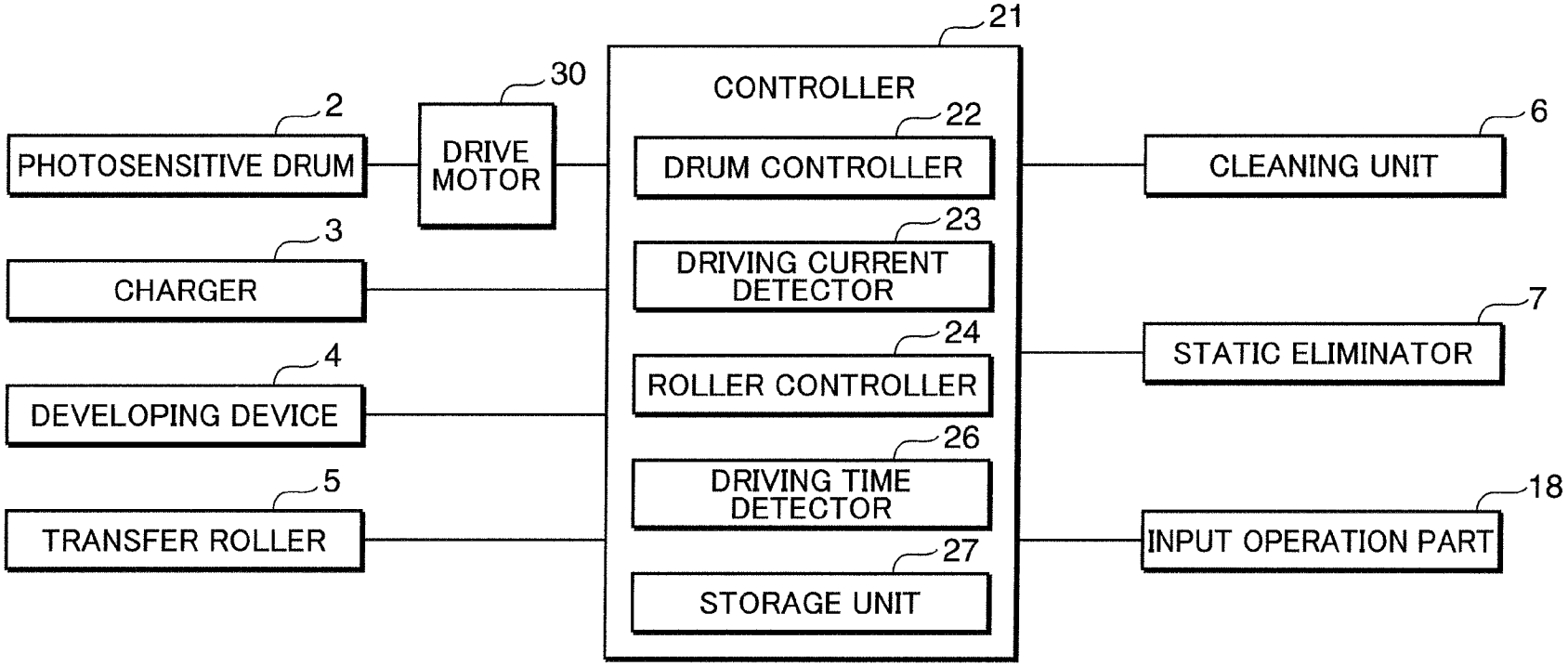
FIG. 7 is a block diagram showing an electrical configuration of an image forming apparatus according to another modification.

Therefore, as shown in FIG. 7, in addition to the configuration according to the first embodiment (the configuration shown in FIG. 3), the controller 21 may further have a driving time detector 26 that detects the driving time of the photosensitive drum 2, and a storage unit 27 that stores, beforehand, the increased amount of the driving current that is generated as the driving time of the photosensitive drum 2 increases.

More specifically, as shown in FIG. 8, the storage unit 27 has stored therein, beforehand, a table showing the correspondence relationship between a driving time T of the photosensitive drum 2 and an increased amount AI of the driving current of the drive motor 30.

Then, when the consumption current is detected by the driving current detector 23, the roller controller 24 derives from the storage unit 27 the increased amount of driving current that is generated by the increase in the driving time of the photosensitive drum 2, which is detected by the driving time detector 26. For example, when the driving current detected by the driving current detector 23 is expressed as "I" and the driving time detected by the driving time detector 26 is expressed as "$T_2$", the roller controller 24 derives $\Delta I_2$ as the increased amount of driving current corresponding to the driving time $T_2$.

The roller controller 24 further subtracts this increased amount from the consumption current detected by the driving current detector 23, and determines, based on the driving current obtained after this subtraction, whether the removal capacity of the cleaning roller 10 to remove the deposits needs to be increased or not. In the example mentioned above, the roller controller 24 subtracts the increased amount $\Delta I_2$ from the driving current I detected by the driving current detector 23 ($I-\Delta I_2$), and determines whether this driving current ($I-\Delta I_2$) is greater than a predetermined threshold value or not.

When the obtained driving current is greater than the predetermined threshold value, the roller controller 24 then increases the rotation speed of the cleaning roller 10 to a predetermined speed during the non-image formation period after the image formation period.

In this manner, the increased amount of driving current that is generated due to the use of the photosensitive drum 2 can be prevented from affecting the determination of whether to increase the removal capacity of the cleaning roller 10 to remove the deposits. Moreover, the roller controller 24 can appropriately determine whether the removal capacity of the cleaning roller 10 to remove the deposits needs to be increased or not.

Note here that the driving time of the photosensitive drum 2 is described as the parameter for estimating the deterioration condition of the circumferential surface of the photosensitive drum 2, the deterioration being caused by the use of the photosensitive drum 2. However, not only the driving time but also the number of prints obtained by the image forming apparatus 1 can be adopted as such a parameter.

Figure 9:
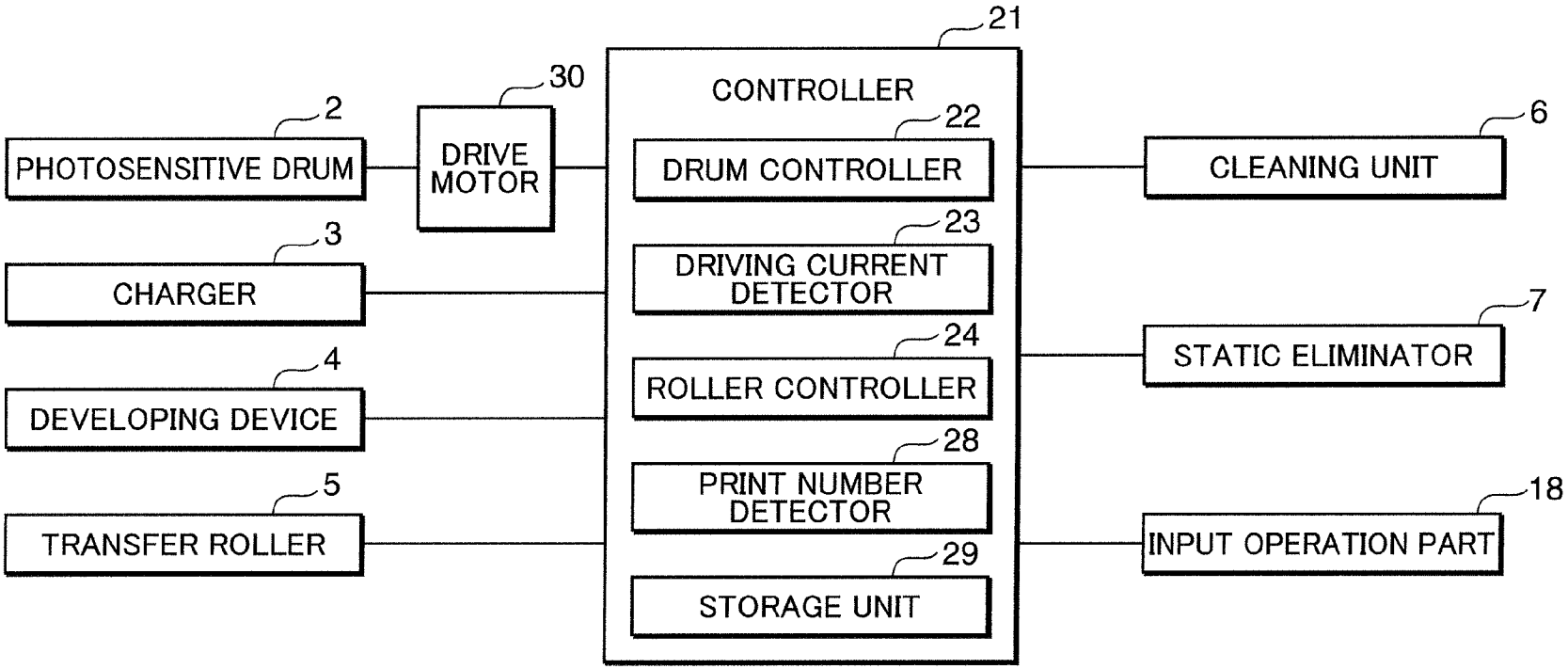
FIG. 9 is a block diagram showing an electrical configuration of an image forming apparatus according to yet another modification.

In other words, as shown in FIG. 9, the controller 21 is further provided with a print number counting part 28 for cumulatively counting the number of prints obtained by the image forming apparatus 1, from the beginning of the use thereof after shipping the image forming apparatus 1 from the factor, and a storage unit 29 that has stored therein, beforehand, the increased amount of driving current that is generated with the increase in the number of prints obtained by the image forming apparatus 1, the increased amount being in the form of a data table in which the driving time T shown in FIG. 8 is replaced with the number of prints. The roller controller 24 derives from the storage unit 29 the increased amount of driving current corresponding to the number of prints counted by the print number counting part 28.

The roller controller 24 subtracts the increased amount from the consumption current detected by the driving current detector 23 and determines whether the consumption current obtained after the subtraction is greater than a predetermined threshold value. When the obtained driving current is greater than the predetermined threshold value, the roller controller 24 raises the rotation speed of the cleaning roller 10 to a predetermined speed during the non-image formation period after the image formation period.

In other words, an image forming apparatus according to an aspect of the present invention has: an image carrier for carrying toner on a surface thereof; a charging part for uniformly charging the surface of the image carrier; an exposure part for forming an electrostatic latent image by performing an exposure operation, based on image data, on the surface of the image carrier after the image carrier is subjected to a charging operation by the charging part; a developing part for developing the electrostatic latent image formed on the surface of the image carrier by using the toner; a transfer part for transferring a toner image formed on the surface of the image carrier, to a predetermined recording medium; a cleaning roller that has a circumferential surface coming into sliding contact with the surface of the image carrier and carrying the toner, and that removes deposits that are deposited on the surface of the image carrier by using the toner that the circumferential surface carries; a carrier driving part for driving the image carrier; a power detector for detecting power consumption of the carrier driving part during an image formation period in which an image forming operation for forming an toner image onto the image carrier based on the image data is performed; and a roller controller for determining, based on the power consumption detected by the power detector, whether a removal capacity of the cleaning roller to remove the deposits needs to be increased or not, and then controlling a rotation operation of the cleaning roller in response to a result of the determination.

According to this configuration, whether the removal capacity of the cleaning roller to remove the deposits needs to be increased or not is determined based on the power consumption of the carrier driving part, and the rotation operation of the cleaning roller is controlled in response to the determination result. Therefore, an appropriate cleaning operation can be carried out using the existing configuration (the power detector) that is provided for purposes other than determining the necessity of increasing the removal capacity to remove the deposits, without mounting a new sensor.

Moreover, it is preferred that a carrier controller for controlling the drive of the image carrier be further provided, wherein the carrier controller sets the driving speed of the image carrier at a preset reference speed during the image formation period by adjusting the power supplied to the carrier driving part.

According to this configuration, when the deposits are deposited on the image carrier, the kinetic frictional force between the image carrier and the cleaning roller increases. As a result, the power supplied to the carrier driving part by the carrier controller is increased in order to maintain the rotation speed of the image carrier at the reference speed during the image formation period. Therefore, the deposition of the deposits on the image carrier increases the power supplied to the carrier driving part, which is the power consumption of the carrier driving part.

In addition, the roller controller preferably rotates the cleaning roller such that the circumferential surface of the cleaning roller moves downward at the contact area between the cleaning roller and the image carrier in the same direction as the surface of the image carrier, and that the circumferential surface scoops the toner upward on the far side of the contact area. When the power consumption detected by the power detector exceeds a predetermined threshold value, the roller controller preferably determines that the removal capacity of the cleaning roller to remove the deposits needs to be increased, and makes the rotation speed of the cleaning roller during the non-image formation period where the image forming operation is not performed, greater than the rotation speed of the cleaning roller during the image formation period.

According to this configuration, when the removal capacity of the cleaning roller to remove the deposits needs to be increased, the rotation speed of the cleaning roller during the non-image formation period is made greater than the rotation speed of the cleaning roller during the image formation period. Therefore, when the removal capacity to remove the deposits needs to be increased, the amount of toner supplied toward the contact area between the image carrier and the cleaning roller is increased by the cleaning roller. As a result, the toner pool is created above the contact area. Consequently, the image carrier and the cleaning roller come into sliding contact with each other through the sufficient amount of toner, whereby the removal capacity of the cleaning roller to remove the deposits is improved.

Furthermore, it is preferred that the image forming apparatus further have a cleaning blade that removes the toner deposited on the surface from the surface by coming into contact with the surface of the image carrier, and a toner receiving member that receives and retains the toner, which has been removed from the surface of the image carrier by the cleaning blade, at a lower part of the cleaning roller, and carries the retained toner, which has reached the circumferential surface of the cleaning roller toner, on the circumferential surface of the cleaning roller.

According to this configuration, the toner receiving member is provided for receiving and retaining, at a predetermined position, the toner that is removed from the circumferential surface of the image carrier by the cleaning blade, and causing the circumferential surface of the cleaning roller to carry the retained toner that reaches the circumferential surface of the cleaning roller. Therefore, the image carrier can be cleaned during the image formation period (the removal operation) without requiring new toner each time when cleaning the image carrier. Particularly when combining this configuration with a configuration in which the removal capacity of the cleaning roller to remove the deposits needs to be increased and the rotation speed of the cleaning roller during the non-image formation period where the image forming operation is not performed is made greater than the rotation speed of the cleaning roller during the image formation period, the toner retained in the toner receiving member can be supplied to the cleaning roller when the rotation speed of the cleaning roller is increased during the non-image formation period. Therefore, the amount of toner supplied can be increased easily in response to the increase in the rotation speed of the cleaning roller.

When the power consumption detected by the power detector exceeds a predetermined threshold value, the roller controller preferably determines that the removal capacity of the cleaning roller to remove the deposits needs to be increased, and controls the rotation operation of the cleaning roller during the non-image formation period where the image forming operation is not performed, so that the absolute value of the difference between the speed of movement of the circumferential surface of the cleaning roller and the speed of movement of the surface of the image carrier during the non-image formation period where the image forming operation is not performed becomes greater than the absolute value of the difference between the speed of movement of the circumferential surface of the cleaning roller and the speed of movement of the surface of the image carrier during the image formation period.

According this configuration, when the removal capacity of the cleaning roller to remove the deposits needs to be increased, the rotation operation of the cleaning roller during the non-image formation period is controlled, so that the absolute value of the difference between the speed of movement of the circumferential surface of the cleaning roller and the speed of movement of the surface of the image carrier during the non-image formation period becomes greater than the absolute value of the difference between the speed of movement of the circumferential surface of the cleaning roller and the speed of movement of the surface of the image carrier during the image formation period. Consequently, the degree of friction between the image carrier and the cleaning roller increases when the removal capacity to remove the deposits needs to be increased. As a result, the removal capacity of the cleaning roller to remove the deposits improves.

In the mode where the absolute value of the difference between the speed of movement of the circumferential surface of the cleaning roller and the speed of movement of the surface of the image carrier during the non-image formation period is made greater than the absolute value of the difference between the speed of movement of the circumferential surface of the cleaning roller and the speed of movement of the surface of the image carrier during the image formation period, when the cleaning roller is rotated during the image formation period such that the circumferential surface of the cleaning roller moves in the same direction as the surface of the image carrier at the contact area between the cleaning roller and image carrier, the rotation direction of the cleaning roller during the non-image formation period may be reversed.

It is preferred that the image forming apparatus further have a driving time detector for detecting a driving time of the image carrier and a storage unit for storing, in advance, an increased amount of the power consumption that is generated due to increase in the driving time of the image carrier, wherein when the power consumption is detected by the power detector, the roller controller derives, from the storage unit, the increased amount of the power consumption corresponding to the driving time of the image carrier that is detected by the driving time detector, subtracts this increased amount from the power consumption detected by the power detector, and determines, based on the power consumption obtained after this subtraction, whether the removal capacity of the cleaning roller to remove the deposits needs to be increased or not.

Depending on the type of the image carrier, the sliding contact state between the image carrier and the cleaning roller (the torque required for rotating the image carrier at constant speed) changes due to change (deterioration) in the condition of the circumferential surface of the image carrier, which is caused by the use thereof, resulting in changes in the power consumed by the image carrier.

Therefore, according to this configuration, the increased amount of the power consumption that is generated with the increase in the driving time of the image carrier is subtracted from the power consumption detected by the power detector, such that the increased amount of the power consumption attributed to the level of usage of the image carrier does not affect the determination of whether to increase the removal capacity of the cleaning roller to remove the deposits. By determining whether to increase the removal capacity of the cleaning roller to remove the depots, based on the power consumption obtained after the subtraction, the impact of the level of usage of the image carrier can be lowered, and the determination of whether to increase the removal capacity of the cleaning roller to remove the deposits can be performed appropriately.

The image forming apparatus may further has a print number counting part for counting the number of prints, and a storage unit for storing, in advance, an increased amount of the power consumption that is generated due to increase in the number of prints, wherein when the power consumption is detected by the power detector, the roller controller derives, from the storage unit, the increased amount of the power consumption corresponding to the number of prints counted by the print number counting part, subtracts the increased amount from the power consumption detected by the power detector, and determines, based on the power consumption obtained after this subtraction, whether the removal capacity of the cleaning roller to remove the deposits needs to be increased or not.

According to this configuration, the increased amount of the power consumption that is generated by the increase in the number of prints is subtracted from the power consumption detected by the power detector, such that the increased amount of the power consumption attributed to the level of usage of the image carrier does not affect the determination of whether to increase the removal capacity of the cleaning roller to remove the deposits. As a result, whether the removal capacity of the cleaning roller to remove the deposits needs to be increased or not is determined based on the power consumption obtained after this subtraction. Therefore, the impact of the level of usage of the image carrier can be lowered, and the determination of whether to increase the removal capacity of the cleaning roller to remove the deposits can be performed appropriately.

Moreover, an image forming apparatus according to an aspect of the present invention has: an image carrier for carrying toner on a surface thereof; a charging part for uniformly charging the surface of the image carrier; an exposure part for forming an electrostatic latent image by performing an exposure operation, based on image data, on the surface of the image carrier after the image carrier is subjected to a charging operation by the charging part; a developing part for developing the electrostatic latent image formed on the surface of the image carrier by using the toner; a transfer part for transferring a toner image formed on the surface of the image carrier, to a predetermined recording medium; a cleaning roller that has a circumferential surface coming into sliding contact with the surface of the image carrier and carrying the toner, and that removes deposits that are deposited on the surface of the image carrier by using the toner that the circumferential surface carries; a print ratio detector for detecting a print ratio of an image formed during an image formation period in which an image forming operation for forming an image onto the image carrier based on the image data is performed; and a roller controller for determining, based on the print ratio detected by the print ratio detector, whether a removal capacity of the cleaning roller to remove the deposits needs to be increased or not, and then controlling a rotation operation of the cleaning roller in response to a result of the determination, wherein the print ratio indicates a ratio of an area in which the toner is deposited to an area of the image formed on the recording medium.

According to this configuration, whether the removal capacity of the cleaning roller to remove the deposits needs to be increased or not is determined based on the print ratio of the image, and the rotation operation of the cleaning roller is controlled in response to the determination result. Therefore, an appropriate cleaning operation can be carried out using the existing configuration (the print ratio detector) without mounting a new sensor. Note that the print ratio is the ratio of the area to be printed in relation to the area in which an image can be formed (the area of a paper sheet).

In addition, the roller controller preferably rotates the cleaning roller such that the circumferential surface of the cleaning roller moves downward at the contact area between the cleaning roller and the image carrier in the same direction as the surface of the image carrier, and that the circumferential surface scoops the toner upward on the far side of the contact area. When the print ratio detected by the print ratio detector is smaller than a predetermined threshold value, the roller controller preferably determines that the removal capacity of the cleaning roller to remove the deposits needs to be increased, and makes the rotation speed of the cleaning roller during the non-image formation period where the image forming operation is not performed, greater than the rotation speed of the cleaning roller during the image formation period.

According to this configuration, when the removal capacity of the cleaning roller to remove the deposits needs to be increased, the rotation speed of the cleaning roller during the non-image formation period is made greater than the rotation speed of the cleaning roller during the image formation period. Therefore, the amount of toner supplied toward the contact area between the image carrier and the cleaning roller is increased by the cleaning roller. As a result, the toner pool is created above the contact area. Consequently, the image carrier and the cleaning roller come into sliding contact with each other through the sufficient amount of toner, whereby the removal capacity of the cleaning roller to remove the deposits is improved.

Furthermore, it is preferred that the image forming apparatus further have a cleaning blade that removes the toner deposited on the surface from the surface by coming into contact with the surface of the image carrier, and a toner receiving member that receives and retains the toner, which has been removed from the surface of the image carrier by the cleaning blade, at a lower part of the cleaning roller, and carries the retained toner, which has reached the circumferential surface of the cleaning roller, on the circumferential surface of the cleaning roller.

According to this configuration, the toner receiving member is provided for receiving and retaining, at a predetermined position, the toner that is removed from the circumferential surface of the image carrier by the cleaning blade, and causing the circumferential surface of the cleaning roller to carry the retained toner that reaches the circumferential surface of the cleaning roller. Therefore, the image carrier can be cleaned as the removal operation during the image formation period without requiring new toner each time when cleaning the image carrier. Particularly when combining this configuration with a configuration in which the removal capacity of the cleaning roller to remove the deposits needs to be increased the rotation speed of the cleaning roller during the non-image formation period where the image forming operation is not performed is made greater than the rotation speed of the cleaning roller during the image formation period, the toner retained in the toner receiving member can be supplied to the cleaning roller when the rotation speed of the cleaning roller is increased during the non-image formation period. Therefore, the amount of toner supplied can be increased easily in response to the increase in the rotation speed of the cleaning roller.

When the print ratio detected by the print ratio detector is smaller than a predetermined threshold value, the roller controller preferably determines that the removal capacity of the cleaning roller to remove the deposits needs to be increased, and controls the rotation operation of the cleaning roller during the non-image formation period where the image forming operation is not performed, so that the absolute value of the difference between the speed of movement of the circumferential surface of the cleaning roller and the speed of movement of the surface of the image carrier during the non-image formation period where the image forming operation is not performed becomes greater than the absolute value of the difference between the speed of movement of the circumferential surface of the cleaning roller and the speed of movement of the surface of the image carrier during the image formation period.

According this configuration, when the removal capacity of the cleaning roller to remove the deposits needs to be increased, the rotation operation of the cleaning roller during the non-image formation period is controlled, so that the absolute value of the difference between the speed of movement of the circumferential surface of the cleaning roller and the speed of movement of the surface of the image carrier during the non-image formation period becomes greater than the absolute value of the difference between the speed of movement of the circumferential surface of the cleaning roller and the speed of movement of the surface of the image carrier during the image formation period. Consequently, the degree of friction between the image carrier and the cleaning roller increases. As a result, the removal capacity of the cleaning roller to remove the deposits improves.

In the mode where the absolute value of the difference between the speed of movement of the circumferential surface of the cleaning roller and the speed of movement of the surface of the image carrier during the non-image formation period is made greater than the absolute value of the difference between the speed of movement of the circumferential surface of the cleaning roller and the speed of movement of the surface of the image carrier during the image formation period, when the cleaning roller is rotated during the image formation period such that the circumferential surface of the cleaning roller moves in the same direction as the surface of the image carrier at the contact area between the cleaning roller and image carrier, the rotation direction of the cleaning roller during the non-image formation period may be reversed.

The image forming apparatus described above can carry out a proper cleaning operation while reducing the risk of a cost increase resulted from mounting a new sensor, as well as preventing or inhibiting the increase of the toner consumption that is caused by using the toner of the developing part not as image formation toner but as the cleaning toner.

This application is based on Japanese patent application No. 2009-155843, filed in Japan Patent Office on Jun. 30, 2009, the contents of which are hereby incorporated by reference.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus, comprising:

an image carrier for carrying toner on a surface thereof;

a charging part for uniformly charging the surface of the image carrier;

an exposure part for forming an electrostatic latent image by performing an exposure operation, based on image data, on the surface of the image carrier after the image carrier is subjected to a charging operation by the charging part;

a developing part for developing the electrostatic latent image formed on the surface of the image carrier by using the toner;

a transfer part for transferring a toner image formed on the surface of the image carrier, to a predetermined recording medium;

a cleaning roller that has a circumferential surface coming into sliding contact with the surface of the image carrier and carrying the toner, and that removes deposits that are deposited on the surface of the image carrier by using the toner that the circumferential surface carries;

a print ratio detector for detecting a print ratio of an image formed during an image formation period in which an image forming operation for forming an image onto the image carrier based on the image data is performed; and a roller controller for determining, based on the print ratio detected by the print ratio detector, whether a removal capacity of the cleaning roller to remove the deposits needs to be increased or not, and then controlling a rotation operation of the cleaning roller in response to a result of the determination, wherein the print ratio indicates a ratio of an area in which the toner is deposited to an area of the image formed on the recording medium, and the roller controller rotates the cleaning roller such that the circumferential surface of the cleaning roller moves downward at a contact area between the cleaning roller and the image carrier in the same direction as the surface of the image carrier, and that the circumferential surface scoops the toner upward on the far side of the contact area, and when the print ratio detected by the print ratio detector is smaller than a predetermined threshold value, the roller controller determines that the removal capacity of the cleaning roller to remove the deposits needs to be increased, and makes the rotation speed of the cleaning roller during a non-image formation period where the image forming operation is not performed, greater than the rotation speed of the cleaning roller during the image formation period.

2. An image forming apparatus, comprising:

an image carrier for carrying toner on a surface thereof;

a charging part for uniformly charging the surface of the image carrier;

an exposure part for forming an electrostatic latent image by performing an exposure operation, based on image data, on the surface of the image carrier after the image carrier is subjected to a charging operation by the charging part;

a developing part for developing the electrostatic latent image formed on the surface of the image carrier by using the toner;

a transfer part for transferring a toner image formed on the surface of the image carrier, to a predetermined recording medium;

a cleaning roller that has a circumferential surface coming into sliding contact with the surface of the image carrier and carrying the toner, and that removes deposits that are deposited on the surface of the image carrier by using the toner that the circumferential surface carries;

a print ratio detector for detecting a print ratio of an image formed during an image formation period in which an image forming operation for forming an image onto the image carrier based on the image data is performed; and a roller controller for determining, based on the print ratio detected by the print ratio detector, whether a removal capacity of the cleaning roller to remove the deposits needs to be increased or not, and then controlling a rotation operation of the cleaning roller in response to a result of the determination, a cleaning blade that removes the toner deposited on the surface from the surface by coming into contact with the surface of the image carrier; and a toner receiving member that receives and retains the toner, which has been removed from the surface of the image carrier by the cleaning blade, at a lower part of the cleaning roller, and carries the retained toner, which has reached the circumferential surface of the cleaning roller, on the circumferential surface of the cleaning roller;

wherein the print ratio indicates a ratio of an area in which the toner is deposited to an area of the image formed on the recording medium, and the roller controller rotates the cleaning roller such that the circumferential surface of the cleaning roller moves downward at a contact area between the cleaning roller and the image carrier in the same direction as the surface of the image carrier, and that the circumferential surface scoops the toner retained in the toner receiving member upward on the far side of the contact area, and when the print ratio detected by the print ratio detector is smaller than a predetermined threshold value, the roller controller determines that the removal capacity of the cleaning roller to remove the deposits needs to be increased, and makes the rotation speed of the cleaning roller during a non-image formation period where the image forming operation is not performed, greater than the rotation speed of the cleaning roller during the image formation period.

3. An image forming apparatus, comprising:

an image carrier for carrying toner on a surface thereof;

a charging part for uniformly charging the surface of the image carrier;

an exposure part for forming an electrostatic latent image by performing an exposure operation, based on image data, on the surface of the image carrier after the image carrier is subjected to a charging operation by the charging part;

a developing part for developing the electrostatic latent image formed on the surface of the image carrier by using the toner;

a transfer part for transferring a toner image formed on the surface of the image carrier, to a predetermined recording medium;

a cleaning roller that has a circumferential surface coming into sliding contact with the surface of the image carrier and carrying the toner, and that removes deposits that are deposited on the surface of the image carrier by using the toner that the circumferential surface carries;

a print ratio detector for detecting a print ratio of an image formed during an image formation period in which an image forming operation for forming an image onto the image carrier based on the image data is performed; and a roller controller for determining, based on the print ratio detected by the print ratio detector, whether a removal capacity of the cleaning roller to remove the deposits needs to be increased or not, and then controlling a rotation operation of the cleaning roller in response to a result of the determination, wherein the print ratio indicates a ratio of an area in which the toner is deposited to an area of the image formed on the recording medium, and when the print ratio detected by the print ratio detector is smaller than a predetermined threshold value, the roller controller determines that the removal capacity of the cleaning roller to remove the deposits needs to be increased, and controls the rotation operation of the cleaning roller during a non-image formation period where the image forming operation is not performed, so that an absolute value of the difference between a speed of movement of the circumferential surface of the cleaning roller and a speed of movement of the surface of the image carrier during the non-image formation period where the image forming operation is not performed becomes greater than an absolute value of the difference between a speed of movement of the circumferential surface of the cleaning roller and a speed of movement of the surface of the image carrier during the image formation period.

4. The image forming apparatus according to claim 3, wherein the roller controller rotates the cleaning roller in a direction in which the circumferential surface of the cleaning roller moves in the same direction as the surface of the image carrier at the contact area between the cleaning roller and the image carrier during the image formation period, and when the print ratio detected by the print ratio detector is smaller than a predetermined threshold value, the roller controller determines that the removal capacity of the cleaning roller to remove the deposits needs to be increased, and reverses a rotation direction of the cleaning roller during the non-image formation period.

* * * * *